US007501043B2

(12) United States Patent
Snekkenes et al.

(10) Patent No.: US 7,501,043 B2
(45) Date of Patent: Mar. 10, 2009

(54) STEAM TREATMENT OF CHIPS WITH THE ADDITION OF AN ACID LIQUID

(75) Inventors: Vidar Snekkenes, Karlstad (SE); Krister Olsson, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 381 days.

(21) Appl. No.: 10/552,563

(22) PCT Filed: Apr. 7, 2004

(86) PCT No.: PCT/SE2004/000545

§ 371 (c)(1),
(2), (4) Date: Oct. 11, 2005

(87) PCT Pub. No.: WO2004/092477

PCT Pub. Date: Oct. 28, 2004

(65) Prior Publication Data

US 2006/0191652 A1 Aug. 31, 2006

(30) Foreign Application Priority Data

Apr. 17, 2003 (SE) ..... 0301163

(51) Int. Cl.
*D21C 3/22* (2006.01)

(52) U.S. Cl. ..... 162/70; 162/17; 162/19; 162/68

(58) Field of Classification Search ..... 162/17, 162/18, 19, 68, 70
See application file for complete search history.

(56) References Cited

U.S. PATENT DOCUMENTS 3,393,121 A * 7/1968 Lea et al. ..... 162/25
4,436,586 A * 3/1984 Elmore ..... 162/19
5,635,025 A * 6/1997 Bilodeau ..... 162/17
5,672,245 A * 9/1997 Andtbacka et al. ..... 162/17
6,203,662 B1 * 3/2001 Snekkenes et al. ..... 162/17

OTHER PUBLICATIONS

Gullichsen et al., Chemical Pulping 6A, Fapet Oy,1999,p. 563-565.*

* cited by examiner

*Primary Examiner*—Eric Hug
*Assistant Examiner*—Anthony J Calandra
(74) *Attorney, Agent, or Firm*—Rolf Fasth; Fasth Law Offices

(57) ABSTRACT

The method is for the pre-treatment of chips that are fed to a sulphate cooking process. Through the addition of an acidic fluid to the steam treatment step, a very high ionic concentration of hydrogen ions is achieved. When the chips are subsequently formed into a slurry with a preferably sulphide-rich alkali cooking fluid, $H_2S$ is formed locally in the chips, which gives a yield-increasing effect for the subsequent cooking step of 1-3%.

8 Claims, 2 Drawing Sheets

STEAM TREATMENT OF CHIPS WITH THE ADDITION OF AN ACID LIQUID

PRIOR APPLICATIONS

This application is a U.S. national phase application based on International Application No. PCT/SE2004/000545, filed 7 Apr. 2004, claiming priority from Swedish Patent Application No. 0301163-2, filed 17 Apr. 2003.

1. Field of Invention

The present invention relates to a method for steam treatment of chips with the addition of an acid liquid.

2. The Prior Art

Several different methods are known in which acid pretreatment steps are used for chips.

A prehydrolysis for the chips, or another cellulose material such as bagasse or other annual plants, is sometimes used where one attempts to form saccharides under relatively stringent conditions, which saccharides are subsequently withdrawn from the chips.

The extracted fluid with the saccharides is subsequently used for other manufacture.

For example, U.S. Pat. No. 3,923,591 reveals such a prehydrolysis of annual plants, in which a special cooking process is subsequently to be used with, among other substances, bisulphite, with the aim of increasing the yield. In order to reach the necessary conditions for the prehydrolysis, temperatures of 160-199° C. (320-390° F.) are required.

U.S. Pat. No. 5,338,366 reveals a further variant of prehydrolysis in which a temperature of 160° C. (320° F.) is recommended (within the specified range 250-350° F./121-173° C.). In this case, principally annual plants (bagasse) are formed to a slurry in an acid fluid at a concentration of 8-12%, followed by dewatering to 35-50% with the aim of limiting the amount of steam required in the subsequent heating. The acid filtrate extracted by pressure is returned to the preceding slurry-formation step. The dewatered bagasse is then transferred to a heating step where the pulp is heated for 20-40 minutes under a pressure of 2-3.5 bar (30-50 psi). The prehydrolysis is thus complete.

In other known acid pretreatment steps, such as EP921-228, the intention is to extract the metals from the chips, whereby the acid fluid with its dissolved metals is removed from the treatment step. This treatment means that a further acid filtrate must be handled in a destruction process or a recycling process, something that places a load on these processes.

It is also possible to treat the chips with $H_2S$ in gaseous form, with the aim of increasing yield. However, these processes suffer from disadvantages in that this gas is toxic and foul-smelling.

A method is revealed in SE,C,506.702 in which one attempts to achieve increased yield from the cooking process, in which sulphide-enriched impregnation fluid at a pH of 4-8, preferably 5-7, is allowed to impregnate the chips. Similar technology is also revealed in U.S. Pat. No. 3,841,962, where increases in yield of 6-7% are claimed, provided that the impregnation with $H_2S$-rich fluid takes place at 120-165° C. for 20-200 minutes and at a partial pressure of $H_2S$ of 10-80 psi, although this takes place at neutral pH 6-7.5. $H_2S$-rich treatment fluid is used in this case, something that also means that there is a risk for the release of $H_2S$ gases.

In most of these acid pretreatment steps, both the prehydrolysis steps and the metal-removal steps, the steps are terminated with the acid fluid in the chips mixture or fibre mixture being mixed or expelled with an alkali cooking fluid, which means that unnecessarily large quantities of alkali fluid are required solely for neutralising the acid chips mixture, or that the alkali fluid accompanies the expelled acid fluid away from the step. This gives an uneconomic handling of the process fluids and filtrates, which cannot be efficiently used in the process, and which require special recycling or destruction systems for the filtrates.

Aim and Purpose of the Invention

The principal aim of the invention is to obtain increased yield from the cooking process in which the chips can be enriched with $H_2S$ without experiencing the disadvantages that known acid pretreatment steps involve.

Through the augmented acidification of the chips during the steam treatment, the natural reduction in pH can be exploited, and a high concentration of hydrogen ions can be established in the chips. Only a small amount of acidic treatment fluid is essentially added, but it is to result in at least a tenfold increase of the concentration of ions in the chips after the steam treatment, which corresponds to a reduction in pH of 1 unit, relative to conventional stream treatment without the addition of an acidic fluid.

Nor does the cellulose have sufficient time to be degraded in the relatively mild conditions and short retention times.

None, or negligible amounts, of the toxic and foul-smelling gas $H_2S$ are formed in the augmented acidification step.

$H_2S$ is formed essentially in the acidified chips once the alkali fluid has been added to the acidified and steamed chip pieces. The alkali fluid with its content of sulphide then reacts with the hydrogen ions $H^+$ that remain in the chip pieces, whereby $H_2S$ is formed essentially solely when it is to be present in order to provide a yield-enhancing effect.

Extensive tests with $H_2S$-enriched chips show that an increase in yield of just over 1-3% can be obtained from the cooking step in an industrial sulphate cooking process, and that the yield can be further increased under certain favourable conditions one or a few more percentage points.

DETAILED DESCRIPTION OF PREFERRED EMBODIMENTS

Figure 1:
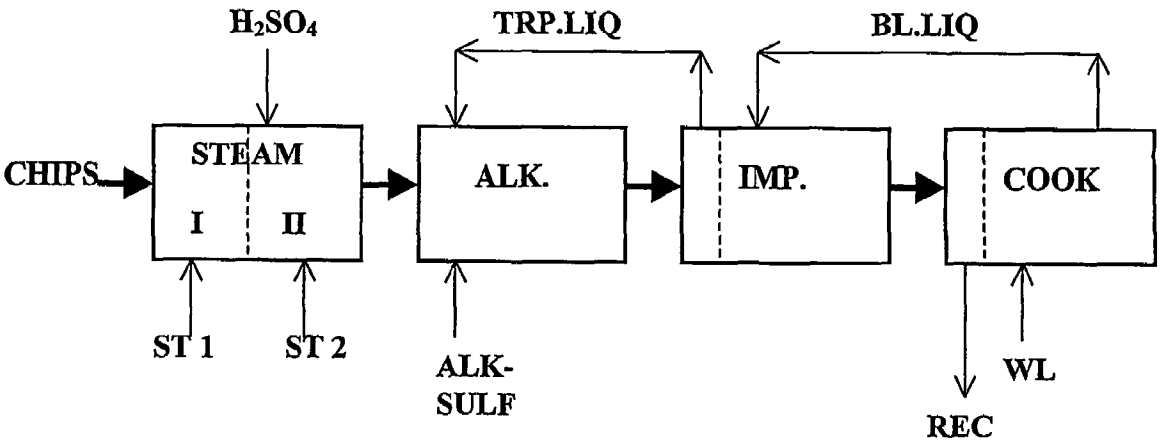
FIG. 1 shows schematically how the method according to the invention can be applied in a process for the manufacture of sulphate pulp.

The principle of the method according to the invention for pre-treatment of chips that are fed into a sulphate cooking process is shown in FIG. 1, where the active addition of acidic fluid, $H_2SO_4$, to the steam treatment constitutes a modification of the process that in other respects is the conventional process.

The chips that are obtained after the chip cutter occupy a large volume in which chips only occupy ⅓ of the volume, the remaining ⅔ being air. Only ⅓ of the chip piece itself is constituted by wood, the remaining part of the chip is constituted by ⅓ chip moisture and ⅓ air.

The chips CHIPS are normally heated with steam as the first measure, which can take place in at least one step STEAM I/STEAM II.

Figure 2:
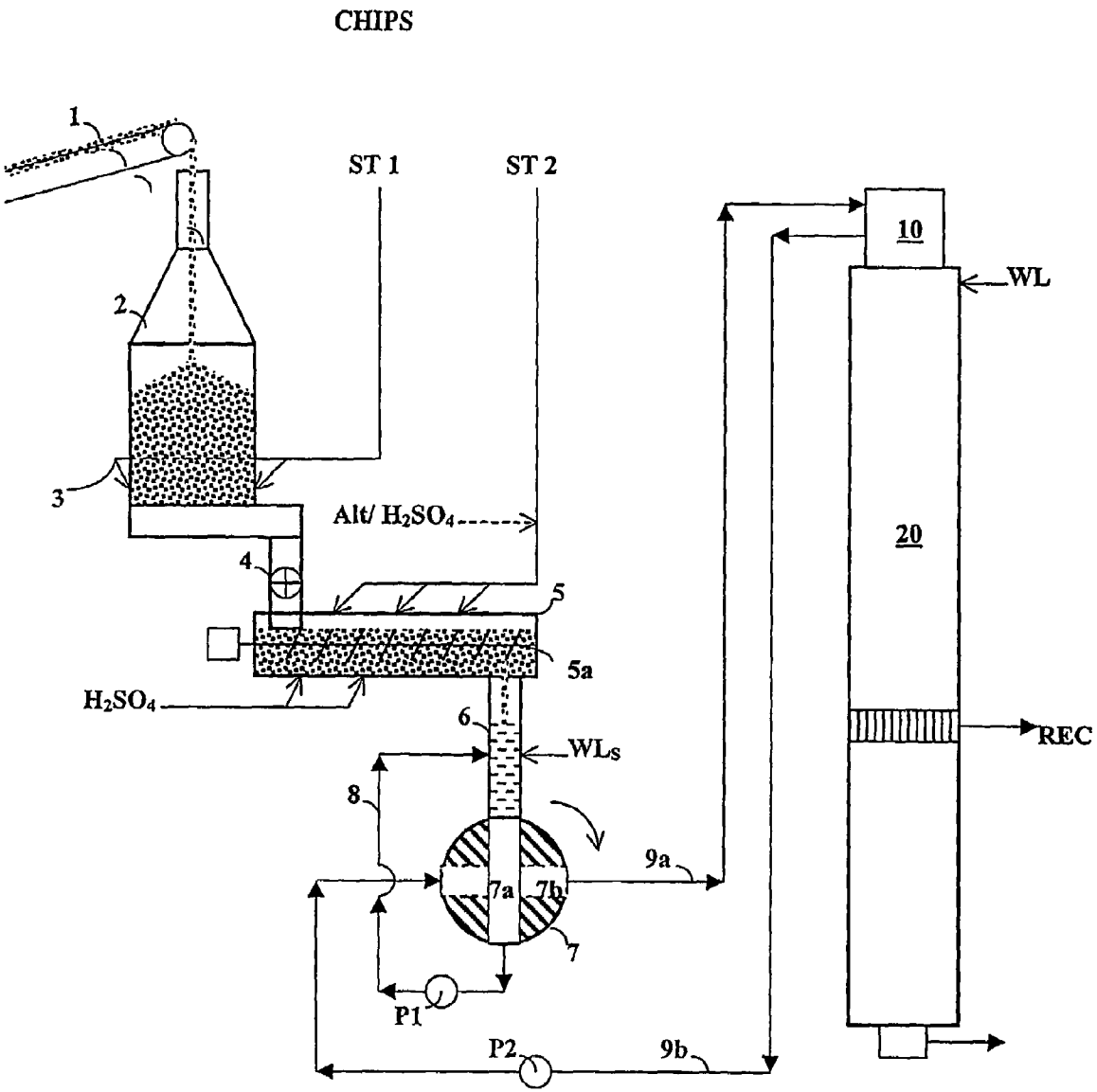
FIG. 2 shows schematically a chip feed system for a continuous digester, with a conventional chip pocket and steaming vessel.

A conventional system is shown in FIG. 2 where the untreated chips 1 are fed with the aid of a transport belt to a chip pocket 2, which is at atmospheric pressure or is slightly pressurised, where low-pressure steam ST 1 is supplied through nozzles 3 in order not only to heat the chips but also to expel air from the chips. The temperature of the chips on exit from the chip pocket normally lies at 80-100° C.

The heated chips are fed/sluiced after the chip pocket through a sluice 4 to a stream treatment vessel 5 (STEAM II in FIG. 1) where the chips are exposed to a more powerful steam treatment at an elevated pressure, in order to expel any remaining residual air and in order to heat the chips by a further 10-20° C. to a chip temperature of 90-120° C.

This steam treatment vessel is often in the form of a horizontal pipe into which the chips are fed at one end and while being transported and stirred by a feed screw 5*a*, feeds the chips during addition of steam ST 2 to the chips It is characteristic for the invention that a suitable acidic fluid, $H_2SO_4$ is shown in FIG. 2, is added to the chips in association with the heating by steam in the steam treatment vessel 5, at an amount that confers upon the chips at least a five-fold, preferably at least a ten-fold, increase of the ionic concentration of hydrogen ions at the end of the steam treatment, compared to a steam treatment without the addition of acidic fluid, whereby the final pH of the chips is reduced by at least 0.5 units and preferably by at least 1 unit.

The acidic fluid has a pH that does not exceed 4-5, and the acidic treatment fluid is added, at least a part of the total amount that is added during the steam heating, preferably 50%-100%, in a pressurised steam treatment vessel, at a pressure in the vessel that exceeds that of the surrounding atmosphere by at least 0.5-2 bar.

It is possible that a part, preferably less than 50%, of the total amount that is added during the steam heating is added to the acidic fluid to a vessel at atmospheric pressure, or a slightly pressurised vessel, at a pressure in the vessel that exceeds that of the surrounding atmosphere by between 0.0-0.5 bar.

If the acidic fluid is sufficiently concentrated, the volume of added acidic fluid can be limited such that this volume does not exceed a volume relative to that of the volume of the chips of 2:1. Weaker alkali fluids can, in this way, be used in the subsequent formation of a slurry.

The alkali impregnation fluid in which the heated and acidified chips are formed to a slurry is constituted by sulphide-rich liquor.

"Sulphidity" is a relative measure of the amount of available sulphide, where sulphidity is given by the relationship:

$$\text{Sulphidity}=Na_2S/(Na_2S+NaOH).$$

A second measure of the amount of sulphide in the fluid can be expressed as the molarity, or mol/litre fluid.

Even normal white liquors that are used in the cooking process contain small amounts of sulphide. Normal white liquor usually has a sulphidity of 30-40% with an $HS^-$ molarity of 1 mol/litre.

The liquors, however, can be enriched in a number of ways. For example, a more sulphide-rich white liquor can be produced with the aid of processes such as the CHEMREC-process. Black liquor is preferably withdrawn from the initial phase of the cooking procedure, and has a high sulphidity of approximately 60-80%. This black liquor can be used to a greater or lesser degree. Conventional black liquor, however, has a low molarity of $HS^-$, around 0.15-0.25 mol/litre.

Black liquor, however, suffers from the disadvantage that it contains released lignin, and this lignin can be reprecipitated onto the fibre, an effect known as lignin condensation, particularly under the acidic conditions that are prevalent in the acidic slurry-forming step.

It is advantageous for an optimal formation of $H_2S$ in the chip piece that the concentration of NaOH is limited, while the concentration of $HS^-$ is maintained at a high level. This is due to the fact that the OH ions diffuse more easily into the chips, and compete with the diffusion of the HS ions. Thus, the alkali fluid that diffuses into the chips directly after the acidification should not consist of pure white liquor, with a high concentration of NaOH.

It is thus appropriate that the alkali impregnation fluid is constituted by a mixture of at least one of sulphide-rich white liquor, sulphide-rich black liquor, and/or sulphide-rich green liquor, and that the alkali impregnation fluid has a molarity of $HS^-$ that exceeds 0.15 mol/litre, preferably one that exceeds 0.25 mol/litre.

For an optimal diffusion of $HS^-$, the alkali impregnation fluid should also have a molarity of NaOH that does not exceed 0.75 mol/litre, preferably one that does not exceed 0.5 mol/litre.

When the sulphide-rich liquor penetrates the chip pieces, the sulphide reacts with the hydrogen ions present in the chip pieces, and $H_2S$ is formed in situ in the chip pieces.

Heating of the chips together with the acidic treatment fluid by steam takes place during a period of 1-20 minutes, preferably 5-10 minutes at a temperature in the range 80-120° C.

It is typical for this heating process that the steam condensation from the steaming process, even without the active addition of an acidic fluid, reaches a pH of 4-5, since naturally occurring acids in the chips are released. Attempts have been made in certain systems to withdraw this acid condensate, since the subsequent slurry formation at the desired alkali pH in alkali cooking fluid or impregnation fluid is opposed. The amount of this acid condensate, however, is so small that it is not normally economically justified to invest in pumps, etc., in order to withdraw the acid condensate, and such systems are extremely prone to clogging. For this reason, it has been the rule in conventional systems to allow this acid condensate to accompany the chips to the subsequent alkalisation step ALK.

After the steaming step, the chips are formed to a slurry with the alkali impregnation fluid ALK_SULF before the cooking step in the digester. The slurry formation is shown schematically in FIG. 1 in the step ALK-SULF, which may correspond to a conventional chute or to a steaming vessel 6 (shown in FIG. 2) following a steam treatment vessel 5, which chute forms the first part of a transport flow to the first digester vessel 20. The chips are formed to a slurry in the chute such that they can be pumped, for onwards transport to the digester vessel either through a sluice feed 7 (high-pressure tap) or directly using pumps.

The transport flow may consist in a conventional manner of a high-pressure tap 7 with a pressurised flow 9*a*/9*b* towards the digester and a low-pressure flow 8 through the pump P1 towards the chute 6. The high-pressure tap and its pockets 7*a*/7*b* rotate and the pocket 7*a* is shown in its position for filling in the low-pressure flow, and the pocket 7*b* is shown in its position for emptying in the high-pressure flow.

A top separator 10 may be present in the high-pressure flow 9*a*/9*b* at the top of the first digester vessel, which top separator withdraws the major part of the transport fluid TRP.LIQ and returns it to the chute and the slurry-forming process through the line 9*b* and its associated pump P2. A first impregnation of the chips can be established in this manner with a specific fluid in the transport flow.

It is then appropriate that the cooking step can be carried out in a one-vessel system or in a two-vessel system, in which the chips are impregnated in a first step IMP with the black liquor BL.LIQ that has been withdrawn from the cooking step. The black liquor that is withdrawn from the cooking step normally has a residual alkali content of 10-60 g/l of effective alkali, and following addition in a first step, the remaining alkali is consumed down to a level of approximately 5-20 g/l. This exhausted black liquor is subsequently withdrawn after the impregnation and before the cooking step to the recovery system REC. New cooking chemicals in the form of white liquor WL are batchwise added to the cooking process following the withdrawal of the exhausted black liquor.

The cooking process that is schematically shown in FIG. 1 corresponds to a cooking process that is preceded by a black liquor impregnation. A conventional cooking process is shown in FIG. 2 with a transfer flow and the establishment of cooking fluid at the top of the digester through the addition of white liquor WL. Exhausted cooking fluid is withdrawn from the digester in these conventional cooking processes and led to the recovery process REC in the customary manner.

However, other cooking processes such as conventional cooking (without black liquor impregnation), LO-SOLIDS (with continuous withdrawal from the cooking process of released organic material), or COMPACT COOKING (with high levels of released organic materials in the cooking step and with a high initial fluid/wood ratio) can, naturally, be used Sufficient acidic pretreatment fluid must be present during the steam treatment such that the chip pieces can be penetrated. Both air and chip moisture in the chip pieces are expelled during the steam treatment, and the acidic environment can be established within the chips.

The acidic treatment fluid that is added during the steam treatment has a pH that does not exceed 4-5, and sulphuric acid ($H_2SO_4$), acetic acid or another acid with a high concentration of free hydrogen ions can be used as a suitable acidic treatment fluid. Since the chips are well-acidified during the steaming step, not only by the release of natural acids within the chips but also by the addition of acidic fluid, the chips will already experience an acidic environment at the start of the steaming step, and release of the naturally occurring acids in the chips reinforces the process such that a high concentration of free hydrogen ions is established in the chips.

In order for the greatest possible amount of $H_2S$ to be formed within the chip pieces, sulphide-rich liquor should constitute the alkali impregnation fluid. Even normal white liquors that are used in the cooking process contain small amounts of sulphide. The liquors, however, can be enriched in a number of ways. For example, a more sulphide-rich white liquor can be produced with the aid of processes such as the CHEMREC-process. Black liquor is preferably withdrawn from the initial phase of the cooking procedure, and has a high sulphidity of approximately 60-80%. This black liquor can be used to a greater or lesser degree. Conventional black liquor, however, has a low molarity of $HS^-$, around 0.15-0.25 mol/litre.

Black liquor, however, suffers from the disadvantage that it contains released lignin, and this lignin can be reprecipitated onto the fibre, an effect known as lignin condensation, particularly under the acidic conditions that are prevalent in the acidic slurry-forming step.

It is advantageous for an optimal formation of $H_2S$ in the chip pieces that the concentration of NaOH is limited, while the concentration of $HS^-$ is maintained at a high level. This is due to the fact that the OH ions diffuse more easily into the chips, and compete with the diffusion of the HS ions. Thus, the alkali fluid that diffuses into the chips directly after the acidification should not consist of pure white liquor, with a high concentration of NaOH.

It is thus appropriate that the alkali impregnation fluid is constituted by a mixture of at least one of sulphide-rich white liquor, sulphide-rich black liquor, and/or sulphide-rich green liquor, and that the alkali impregnation fluid has a molarity of $HS^-$ that exceeds 0.15 mol/litre, preferably one that exceeds 0.25 mol/litre.

For an optimal diffusion of $HS^-$, the alkali impregnation fluid should also have a molarity of NaOH that does not exceed 0.75 mol/litre, preferably one that does not exceed 0.5 mol/litre.

When the sulphide-rich liquor penetrates the chip pieces, the sulphide reacts with the hydrogen ions present in the chip pieces, and $H_2S$ is formed in situ in the chip pieces.

The invention can be varied in a number of ways within the framework of the attached claims. Other types of cooking process, for example, can be used, as has been previously pointed out. The cooking process may also be of the simplified type in which chips are fed by pumps between one or several steps without recycling of transport fluid (TRP.LIQ) and where the major part of the cooking fluid established in the cooking step is added at the slurry-formation position.

While the present invention has been described in accordance with preferred compositions and embodiments, it is to be understood that certain substitutions and alterations may be made thereto without departing from the spirit and scope of the following claims.

The invention claimed is:

1. A method for the treatment of chips, comprising:

heating the chips with steam in a steam treatment inside a steam treatment vessel, adding an acidic fluid to the chips disposed in the steam treatment vessel while the chips are being steamed in the steam treatment vessel in an amount that gives the chips at least a five-fold increase in an ionic concentration of hydrogen ions at an end of the steam treatment compared to steam treatment without adding the acidic fluid, in the steam treatment vessel, heating the chips together with the acidic fluid by the steam for a period of 1-20 minutes, the chips falling down through a chute connected to the steam treatment vessel, adding an alkali impregnation fluid to the chute while the chips fall therethrough, forming the chips to a slurry in the chute with the alkali impregnation fluid, wherein said alkali impregnation fluid comprises a liquor with sulfides, conveying the slurry to a digester, and cooking the chips in the digester.

2. The method according to claim 1 wherein the acidic fluid has a pH that does not exceed 4 and the acidic treatment fluid is at least partially added in a pressurized steam treatment vessel, at a pressure in the vessel that exceeds that of a surrounding atmosphere by at least 0.5 bar.

3. The method according to claim 1 wherein the acidic fluid has a pH that does not exceed 4 and the acidic treatment fluid is partially added at least in a vessel at atmospheric pressure or at a slightly higher pressure, at a pressure in the vessel that exceeds that of a surrounding atmosphere by between 0 and 0.5 bar.

4. The method according to claim 2 wherein a volume of the added acidic fluid relative to a volume of the chips does not exceed 2:1.

5. The method according to claim 1 wherein the alkali impregnation fluid in which the heated and acidified chips are formed into a slurry is constituted by a sulphide-rich liquor.

6. The method according to claim 5 wherein the alkali impregnation fluid is constituted by a mixture of at least one of a sulphide-rich white liquor, sulphide-rich black liquor, and/or sulphide-rich green liquor, and the alkali impregnation fluid has a molarity of $HS^-$ that exceeds 0.15 mol/liter.

7. The method according to claim 6 wherein the alkali impregnation fluid has a molarity of NaOH that does not exceed 0.75 mol/liter.

8. The method according to claim 1 wherein the heating by steam of the chips together with the added acidic fluid at a temperature in a range of 80-120° C.

* * * * *